United States Patent [19]

Ferwagner

[11] 3,977,228

[45] Aug. 31, 1976

[54] TOOL FOR FORMING PIPE FROM SHEET METAL

[76] Inventor: Josef Ferwagner, Bochum, Germany

[22] Filed: Aug. 16, 1974

[21] Appl. No.: 498,283

[30] Foreign Application Priority Data

Aug. 18, 1973 Germany ..... 2341857

[52] U.S. Cl. ..... 72/384; 72/344; 72/427

[51] Int. Cl.[2] ..... B21D 17/02

[58] Field of Search ..... 72/380, 381, 382, 383, 72/384, 386, 389, 392, 394, 395, 427, 344, 347, 348, 351

[56] References Cited

UNITED STATES PATENTS

| | | | |
|---|---|---|---|
| 445,238 | 1/1891 | Beach | 72/344 |
| 1,875,954 | 9/1932 | Taylor | 72/381 |
| 2,162,731 | 6/1939 | Lyon | 72/380 |
| 2,419,563 | 4/1947 | Kaser | 72/347 |
| 2,649,128 | 8/1953 | Schoellerman | 72/381 |
| 2,939,349 | 6/1960 | Smith | 72/344 X |
| 3,429,172 | 2/1969 | Lierse et al. | 72/427 X |

FOREIGN PATENTS OR APPLICATIONS

| | | | |
|---|---|---|---|
| 4,630,582 | 6/1971 | Japan | 72/383 |

*Primary Examiner*—C.W. Lanham
*Assistant Examiner*—James R. Duzan
*Attorney, Agent, or Firm*—McGlew and Tuttle

[57] ABSTRACT

An apparatus for forming pipe from sheet metal, comprises a preforming die having laterally spaced substantially parallel walls and an interior surface spaced inwardly from an edge of the wall and located between the walls in which are mounted a pair of transversely spaced curved segments shaped to receive the outside surface of the sheet when it is formed into a pipe. Piston and cylinder combinations carry each segment so that they may be moved outwardly or inwardly for regulating the degree of bending of the sheet therebetween. A drawing punch includes a curved forming punch surface with a holding down element at each end which are constructed so as to be movable into and out of the space between the parallel walls. The apparatus also includes a finishing tool which comprises a receiving die shaped to the outer diameter of the pipe to be formed. The finishing tool also includes a punch mounted on a piston rod for inward and outward movement which operates in conjunction with a two-part mandrel having two half portions which may be swung either inwardly or outwardly on pivots in order to vary the diameter of the engagement surface of the mandrel which is moved by the punch into forming engagement with the sheet. The two half portions of the mandrel are fixed to a cross-bar which carries the piston rod which carries the punch. During formation of the final pipe bends, the portions which have not been operated upon in the preforming are bent inwardly and are closed to form the round pipe formation.

5 Claims, 6 Drawing Figures

TOOL FOR FORMING PIPE FROM SHEET METAL

BACKGROUND OF THE INVENTION

1. Field of the Invention

This invention relates in general to the construction of pipe-forming devices and, in particular, to a new and useful apparatus for forming pipe from sheet metal including both a preforming die and punch and a finishing tool, including a punch with separately pivotable mandrel parts.

2. Description of the Prior Art

In the known tooling arrangements for making pipe bends by cold shaping a piece of sheet metal, a preforming tool with a preforming die and a drawing punch are used for shaping the back of the bend. The preforming die has a cross-sectional shape which includes two spaced parallel surfaces between which there is a semicircle corresponding to the back formation of the pipe bend to be formed. Therefore, when the drawing punch descends, the longitudinal side parts of the sheet project out of the side into the open. A finishing tool includes a reforming die which is used as the holding die. A two-part mandrel is inserted by hand into the preformed sheet and a punch is moved to seize the longitudinal side parts of the sheet which project out of the preforming die and which is used as a holding die in the finishing operation. The sheet is bent around the mandrel in order to form the pipe bend. After the mandrel is removed, the edges of the longitudinal side parts of the sheet which run along the inside of the bend are joined together by a continuous weld. With such a known tooling arrangement, only bends with relatively thick walls in relation to the diameter can be satisfactorily made because, as the wall thickness decreases, the sheet tends to form folds when being operated on both by the preforming and the finishing tools. These folds cannot be removed even during the complete closing of the preforming which occurs by action of the finishing tools. In addition, the awkward manipulation which is involved in the known tooling arrangement is troublesome, particularly in respect to the use of the mandrel which is required by the finishing tools.

SUMMARY OF THE INVENTION

In accordance with the present invention, there is provided a tooling arrangement for making pipe bends by cold shaping a piece of sheet metal which comprises a preforming tool with a preforming die and a drawing punch for shaping the back of the bend. The receiving die has spaced usually vertical walls which define inside surfaces of the receiving die which are parallel to outside longitudinal surfaces of the drawing punch. The drawing punch includes holding down elements at each of the curved punch which can travel into and out of the die between the spaced walls. The die includes die segments which are curved to the outer configuration of the pipe to be formed and which are mounted so as to be movable outwardly and inwardly in radial directions for changing their position in order to change the degree of deformation of the pipe therebetween.

With the inventive arrangement, the longitudinal side faces of the sheet are completely drawn into the longitudinal gap formed between the space walls of the preforming die so that no fold formation can occur. The holding-down elements of the punch prevent any fold formation near the outer ends of the pipe bend. The holding-down elements engage the sheet metal before the punch and thereafter only the middle portion of the back of the bend between the die segments is shaped. It is only after this that the parts of the bend bordering on the middle part are shaped.

In accordance with a further feature of the invention, the two halves of the mandrel of the finishing tool are affixed to swinging arms and the swinging arms are pivoted on a cross-bar which carries the closing punch and the mechanism for moving the punch. The mechanism for moving the punch advantageously comprises a fluid pressure operated piston which is movable in a cylinder mounted on the cross-bar and connected to the mandrel in order to adjust the height thereof. By uniting the mandrel with the closing punch, not only is the separate manipulation of the mandrel dispensed with, but, at the same time, any formation of folds in the finishing tool is prevented.

Accordingly, it is an object of the invention to provide an improved finishing tool which includes a prefinishing tool assembly which includes a preforming die having laterally spaced substantially parallel walls and having a pair of curved transversely spaced segments between the walls which are shaped to receive the outside surface of the sheet and which are mounted so that they may move radially inwardly and outwardly in order to regulate the degree of bending of the sheet therebetween when a drawing punch mounted thereover is moved into and out of the space between the walls.

A further object of the invention is to provide a finishing tool which includes a receiving die or a preformed sheet which is located between a movable punch which is operable in association with a forming mandrel having two mandrel segmental parts which are pivotal on a support for closing and opening movement in order to vary the arc of engagement thereof.

A further object of the invention is to provide a forming tool for forming pipe from sheet metal which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there are illustrated preferred embodiments of the invention.

DESCRIPTION OF THE PREFERRED EMBODIMENTS

Figure 1:
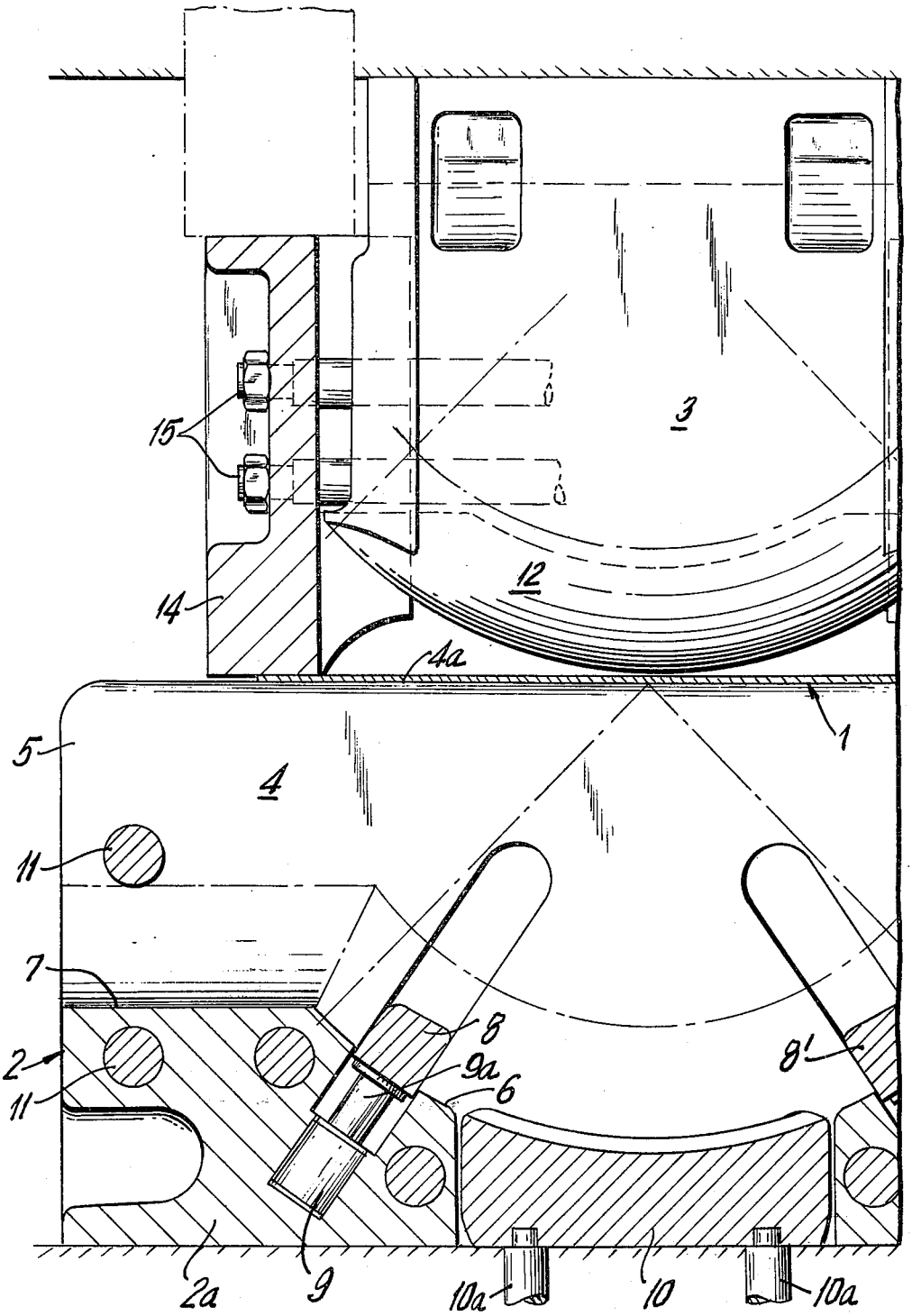
FIG. 1 is a partial front elevational and transverse sectional view of a preforming tool assembly constructed in accordance with the invention.
Figure 2:
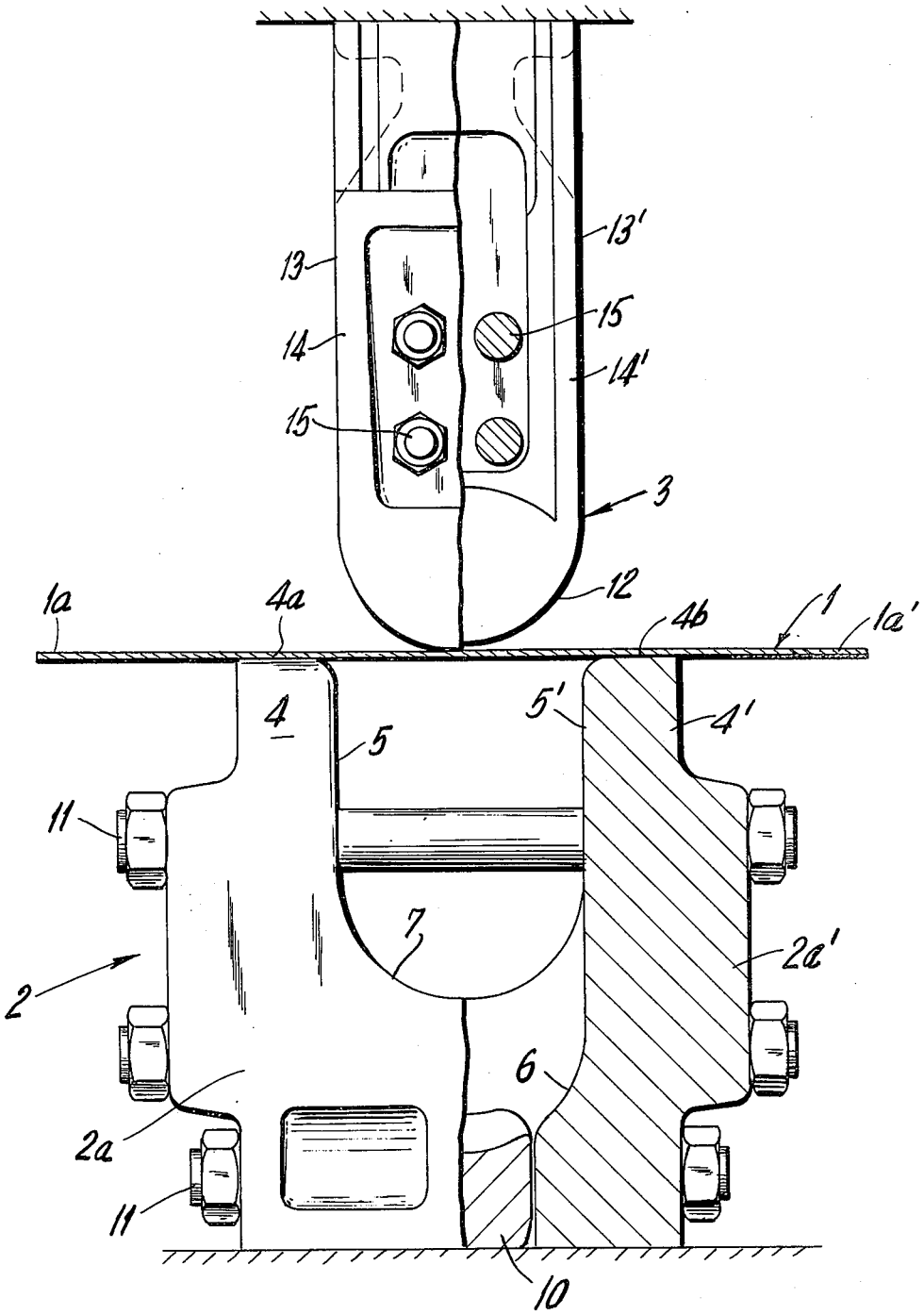
FIG. 2 is a partial side elevational and longitudinal sectional view of the apparatus shown in FIG. 1.
Figure 3:
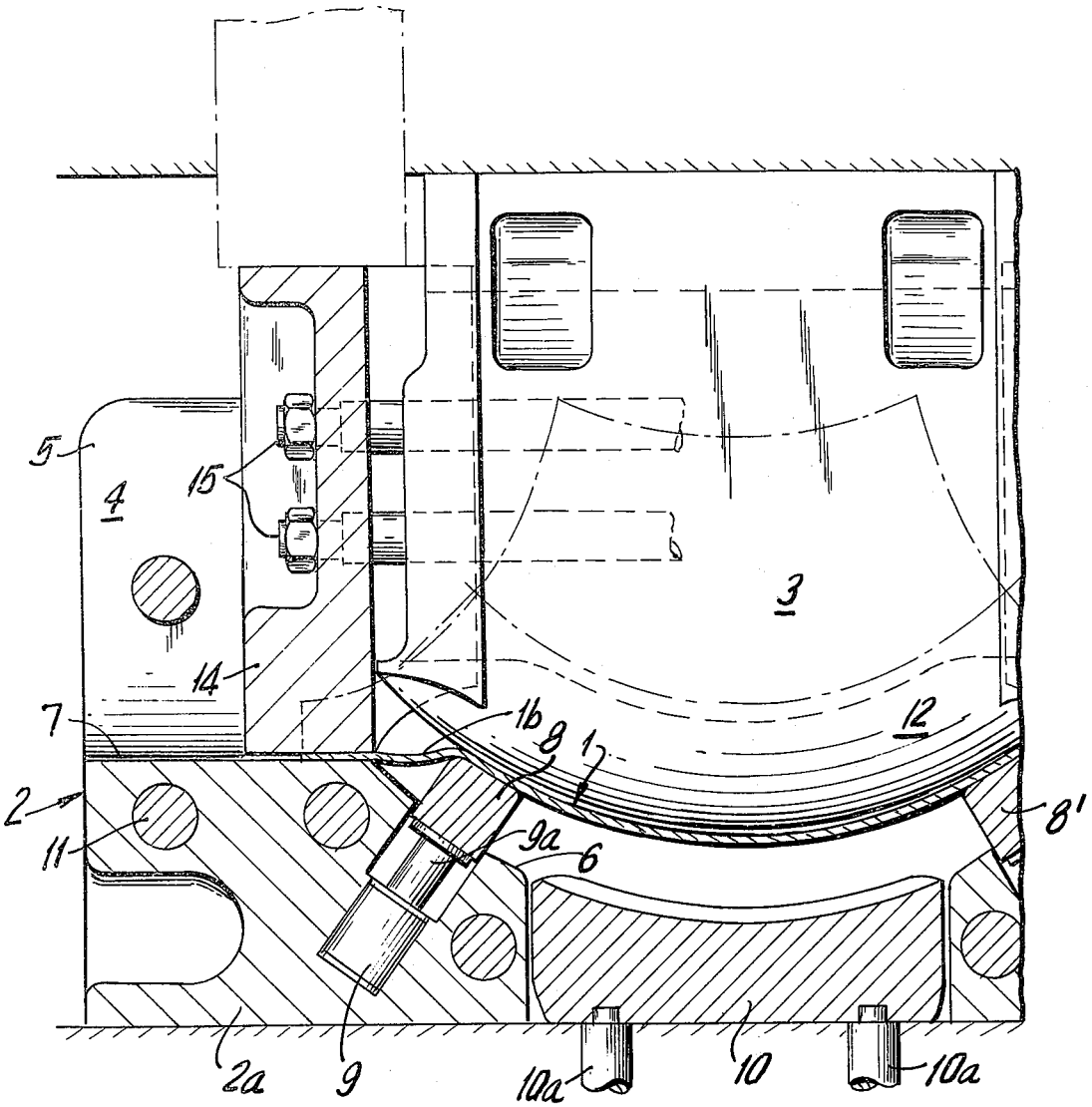
FIG. 3 is a view similar to FIG. 1 showing the parts in an advanced position of operation.

Referring to the drawings in particular, the invention embodied therein in FIGS. 1 to 3, comprise an apparatus for making pipe bends by cold shaping a piece of sheet metal 1. In the example, the pipe bends have an angle of 90° but pipe bends with a smaller angle can be made by correspondingly designing the tooling arrangement. The tooling arrangement of the invention comprises a preforming assembly which includes a preforming die, generally designated 2, which is arranged below a cooperating preforming punch, generally designated 3, and also a set of finishing tools shown in the embodiment of FIGS. 4 to 6, which include a receiving die, generally designated 16, and a forming mandrel, generally designated 17, which cooperates with a movable punch 18.

In the embodiment of FIGS. 1 to 3, the preforming tools are used for shaping the back of the pipe bend and comprise a preforming die, generally desingated 2, which operates in conjunction with the drawing punch 3. The preforming die, in accordance with the invention, has two transversely spaced longitudinal walls 4, 4', having substantially vertical inside surfaces 5 and 5' which are transversely spaced by a distance which corresponds to the outer diameter of the pipe bend being formed. Between the inside surfaces 5 and 5' of the preforming die 2 there is a shaped part 6 which corresponds to the back of the pipe bend which is being made. This shaped part 6 runs out at the ends into a U-shaped counter-supporting surface 7 at each end.

In accordance with a feature of the invention, two transversely spaced segments 8 and 8' are mounted between walls 4 and 4' over the surface 6. Means are connected to segments 8 to displace them radially inwardly or outwardly in order to vary the point at which they engage with sheet 1 when it is being formed and thus vary the amount of deformation thereof. The means for moving segments 8 comprise fluid pressure operated cylinders 9 having pistons movable therein which are connected through piston rods 9*a* to the associated segments 8 and 9. An ejector 10 is located centrally between the segments 8 and 8' and it is mounted on rod elements 10*a* which are movable for the purpose of ejecting the pipe after it has been preformed.

The preforming die, generally designated 2, is advantageously made of two half portions 2*a* and 2*a*' which are divided in the longitudinal direction, and the two half portions are held together by threaded bolts 11. The two half portions 2*a* and 2*a*' and the ejector 10 and the retractable die segments 8 and 8' form part of the shaped part 6.

The drawing punch 3 has a shaped part 12 at its bottom end which corresponds to the inside shape of the back of the pipe bend being made. This shaped part 12 runs out into the vertical external longitudinal surface 13 and 13' on the respective sides of the punch 3. The surfaces 13 and 13' are parallel to the respective surfaces 5 and 5' of the die 2 and the distance between these surfaces 13 and 13' corresponds to the internal diameter of the pipe bend being made. Holding-down elements 14 are arranged at surfaces which are perpendicular to the surface 13 on each end of punch 3. Holding-down elements 14 are joined together by external anchor bolts 15. When drawing punch 3 is moved downwardly, the side surfaces 13 and 13' move between the walls 5 and 5'. The whole of the preforming tools 2 and 3 are constructed symmetrically, both in respect to the vertical mid longitudinal plane and the transverse mid plane.

The operation of the device is as follows:

A flat piece of sheet steel or sheet metal 1, which is cut out in some suitable manner, for example by stamping, is laid on the top surfaces 4*a* and 4*b* of the half portions 2*a* and 2*a*' of the preforming die 2. Drive means (not shown) connected to the drawing punch 3 causes it to move downwardly to bring the holding elements 14, 14' into engagement with the sheet 1 shortly before contact of the sheet by the drawing punch 3. (See FIGS. 1 and 2). As the punch 3 and the holding-down elements 14, 14' descend further, the sheet 1, including side portions 1*a* and 1*a*' lying outside of walls 4 and 4' is completely drawn in between the longitudinal walls 4 and 4' of the preforming die 2 and punch 3, and this shapes it into a U-shape cross-section. When holding-down elements 14 come down into the counter-supporting surfaces 7, then the undeside of sheet 1 touches the die segments 8, which in the meantime have been pushed upwardly to the level of the counter-supporting surfaces 7. Punch 3 now descends further and deforms sheet 1 between the stationarily held die segments 8, 8' to make the back of the pipe bend. The sheet includes parts 1*b*, as shown in FIG. 3, which are situated between the die segments 8 and the holding-down elements 14 and the counter-supporting surfaces 7 and undergo practically no deformation. As punch 3 descends still further, the die segments 8 are pushed backwardly and, therefore, the parts 1*b* of the back of the pipe bend is then shaped. By the described use of the holding-down elements 14 and the die segments 18, the formation of folds and kinks in the region of the ends of the longitudinal sides of the back of the pipe bend is prevented.

After raising the punch 3 and the holding-down elements 14, 14, the preformed sheet is lifted out of the preforming die by operating the ejector 10.

Figure 4:
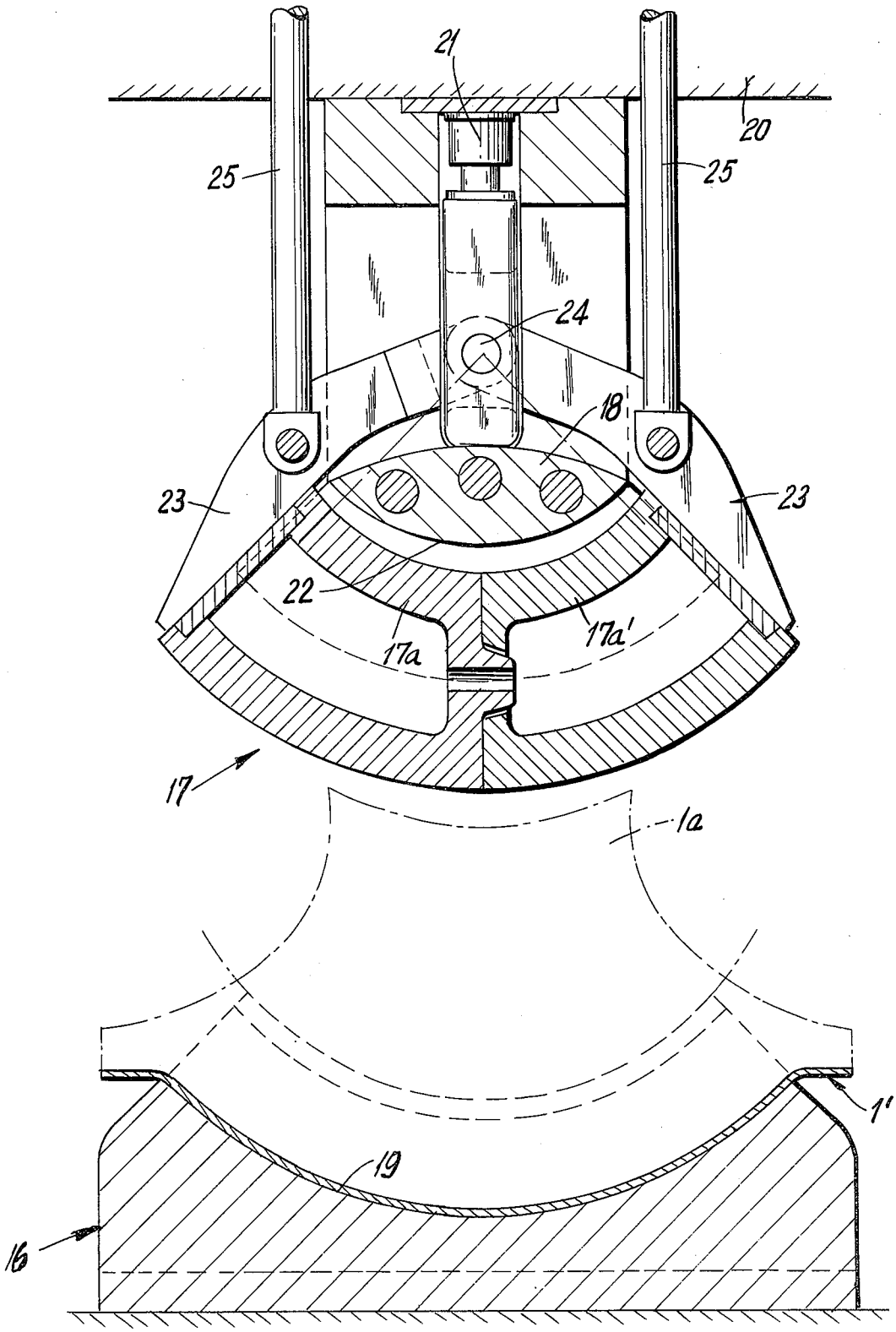
FIG. 4 is a partial transverse sectional view of the finishing apparatus constructed in accordance with the invention.
Figure 5:
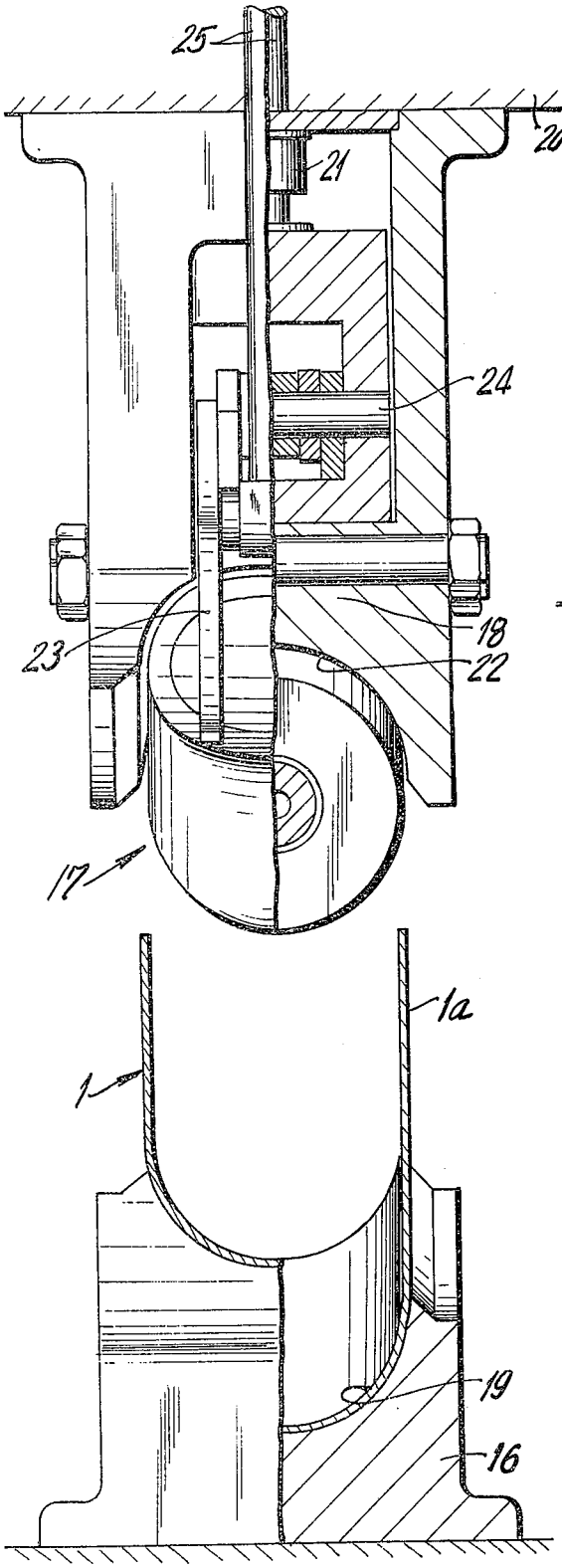
FIG. 5 is a partial side elevational and longitudinal sectional view of the apparatus shown in FIG. 4.
Figure 6:
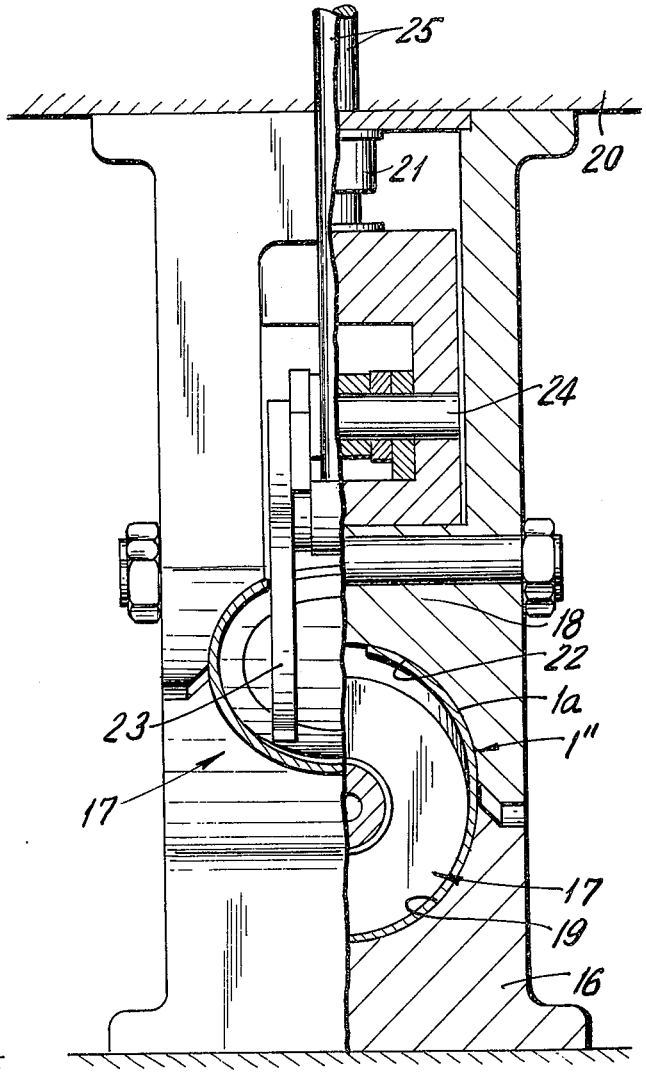
FIG. 6 is a view similar to FIG. 5 showing the parts in an advanced position of operation.

In the embodiment shown in FIGS. 4 to 6, the finishing forming tools are used for closing up the preformed sheet 1 into the pipe bend and they comprise a holding die 16, a mandrel 17 and a closing punch 18. The holding die 16 has a shaped part 19 which corresponds to the back of the pipe bend and the sheet 1 is laid therein after it is preformed with the preforming tools 2 and 3.

A cross-bar 20 is mounted above holding die 16 and it can be moved upwardly and downwardly. A closing punch 18 is connected by means of a cylinder and piston unit 21 to the cross-bar and is movable upwardly and downwardly in respect thereto so as to be adjustable for height. Closing punch 18 includes a bottom end 22 which is shaped to the form of the outside surface of the bend and it continues around from the back of the bend.

In accordance with a further feature of the invention, the mandrel 17 includes two half portions 17*a* and 17*a*' which are of segmental configuration and which are divided transversely. Each half portion 17*a* and 17*a*' is fixed to the end of a swinging arm 23 having a common pivot 24 which is fastened to the cross-bar 20. Operating rods 25 are linked to swinging arms 23 and they may be moved upwardly and downwardly in order to displace the half portions 17*a* and 17*a*' inwardly and outwardly in a curved arcuate movement in order that they may define a particular curve of the bend.

The operation of the apparatus shown in FIGS. 4 to 6 is as follows:

The preformed sheet 1' is laid in the holding die 16 and the closing punch 18 is located at a distance from the mandrel 17 after the two half portions 17*a* and 17*a'* have been swung together. The spacing of the punch 18 from the mandrel 17 is at a spacing which is greater than the thickness of the finished pipe bend on the inside of the bend (see FIGS. 4 and 5). During the descent of the mandrel 17 and the closing punch 18, this distance is initially retained. Because of the spacing between mandrel 17 and closing punch 18, the longitudinal side parts 1*a*, which project out of holding die 16, penetrate into the gap formed between the mandrel and the punch. During the downward movement of closing punch 18 and mandrel 17, the longitudinal edges of the two side parts 1*a* are bent inwardly toward each other, as shown in FIG. 6.

After mandrel 17 holding die 16 have made contact, the closing punch 18 travels a little further and closes up sheet 1 completely. Closing punch 18 is then retracted by the amount of the closing movement, whereupon, the finally shaped pipe bend 1 expands slightly because of its elastic properties so that the halves 17*a*, 17*a'* of the mandrel can easily be swung out of the pipe bend 1'' by operating the swinging arms 23. After removing the pipe bend 1'' from the holding die 16, the edges on the inside of the bend are welded together. The end pieces at the ends of the outside of the bend with which the sheet 1 was held with the preforming tools 2 and 3 between the holding-down elements 14 and the counter-supporting surfaces 7, are removed.

While specific embodiments of the invention have been shown and described in detail to illustrate the application of the principles of the invention, it will be understood that the invention may be embodied otherwise without departing from such principles.

I claim:

1. A tool for forming pipe from sheet metal comprising a preforming die having a pair of opposed transversely spaced longitudinal walls with top flat surfaces for supporting a sheet to be formed and with substantially vertical inside opposed die surfaces spaced apart by a distance corresponding to the outside diameter of the pipe bend being formed, said walls also having a shaped part corresponding to the back of the pipe bend being formed between said surfaces and a stop surface at each end of said shaped part extending above the shaped part, a pair of transversely spaced segments overlying said shaped part, means connected to said segments for displacing them inwardly and outwardly radially for varying the point at which they engage the sheet to be formed into the pipe, the drawing punch overlying said die having a hold-down element at each end engageable with a respective stop surface to hold the sheet thereon and having a shaped punch part adjacent its bottom corresponding to the inside shape of the back of the pipe being made with a punch surface on each side of said shaped punched part substantially parallel to said inside opposed die surfaces, said segments being movable radially outwardly up to the level of said stop surfaces.

2. A tool for forming a pipe from sheet metal, according to claim 1, wherein said preforming die and said drawing punch comprise two half portions divided in a symmetrical longitudinal plane.

3. A tool for forming pipe from sheet metal, according to claim 1, wherein said holding-down elements and said die segments are arranged symmetrically to the transverse mid plane of said preforming die.

4. A tool for forming pipe from sheet metal, according to claim 1, including anchor bolts connected through said holding-down elements to hold said elements to said punch.

5. A tool for forming pipe from sheet metal, according to claim 4, including an ejector disposed between said segments for removing the workpiece after it is formed.

* * * * *